US005437607A

United States Patent [19]

Taylor

[11] Patent Number: 5,437,607

[45] Date of Patent: Aug. 1, 1995

[54] VIBRATING MASSAGE APPARATUS

[75] Inventor: Charles Taylor, San Francisco, Calif.

[73] Assignee: HWE, Inc., North Hollywood, Calif.

[21] Appl. No.: 892,176

[22] Filed: Jun. 2, 1992

[51] Int. Cl.[6] ..... A61H 1/00

[52] U.S. Cl. ..... 601/49; 601/57; 601/48

[58] Field of Search ..... 601/46, 48–54, 601/56–62, 65–70, 78, 107, 108, 111

[56] References Cited

U.S. PATENT DOCUMENTS

| | | | |
|---|---|---|---|
| 4,465,158 | 8/1984 | Yamazaki | 128/33 |
| 4,535,760 | 8/1985 | Ikeda | 128/36 |
| 4,686,968 | 8/1987 | Scherger | 128/33 |
| 4,779,615 | 10/1988 | Frazier | 128/54 |
| 5,007,410 | 4/1991 | DeLaney | 128/36 |
| 5,022,384 | 6/1991 | Freels | 128/36 |

*Primary Examiner*—Robert A. Hafer
*Assistant Examiner*—David J. Kenealy
*Attorney, Agent, or Firm*—Michael A. Painter

[57] ABSTRACT

An improved vibrating massage apparatus in the form of an elongated pad incorporating a plurality of independently controllable vibrating members to impose vibratory oscillations along the full extent of the apparatus. Each vibrating member includes a motor having a pair of rotatable shafts extending outward therefrom in axial opposition to one other, a fixed eccentric weight being secured at the end of each shaft. Each vibrating motor is secured within a housing, the outer surface thereof extending outwardly into a planar flange. The planar flanges of the motor housings are imbedded within a unitary foam member which substantially defines the shape of the pad. An electrical switching circuit sequentially activates and deactivates each of the vibrating motors in a predetermined manner.

3 Claims, 3 Drawing Sheets

VIBRATING MASSAGE APPARATUS

BACKGROUND OF THE INVENTION

1. Field of the Invention

The present invention generally relates to personal massaging devices and more particularly to a massage apparatus in the form of a pad wherein a series of vibrating members are programmed for sequential activation.

2. Prior Art

The present invention generally comprises a massage apparatus in the form of a pad which employs a plurality of vibrating members which are disposed along the length of the pad and which are activated and deactivated in a predetermined sequence. The prior art discloses numerous massaging devices in the forms of chairs, pads and the like. Although all of the devices taught by the prior art function in a manner whereby each transmits vibratory motion to a user, all have inherent inadequacies which are overcome by the present invention.

A basic device taught by the prior art utilizes a motor employing an eccentric cam, the motor being mounted to a rigid surface on the underside of a rigid member upon which the user is to sit or recline. The mounting member is disposed upon shock absorbing blocks. Padding or other cushioning material is disposed on the upper surface of the rigid member to which the vibrating motor is secured. The vibrating motor, when electrically activated, will impart a vibratory motion to the rigid member to which it is secured. Neither the amplitude nor the frequency of the vibratory motion is adjustable. Furthermore, operation is inefficient since the vibratory motion will be attenuated by transmission through the rigid surface and padding. The present invention substantially resolves the inadequacies inherent in this device by imbedding the vibratory members within a unitary pad of polyurethane foam. By using a unitary foam structure within which the vibrating members are mounted, the motion created by each member will be uniformly transmitted throughout the pad. Most importantly, when the vibrating motors are activated and deactivated in a sequential manner, the use of uniform supporting foam will result in the uninterrupted transition of the vibratory motion between each pair of sequentially activated motors.

Another device taught by the prior art constitutes a vibrating mattress or pad which mounts a plurality of vibrating units between a pair of planar, resilient members. The vibrating units each comprise a battery activated motor which rotates a shaft which supports an adjustable eccentric weight. The vibrating motors are secured within housings which are disposed along the discrete interface between the two resilient members. The inadequacies of this structure are inherent in the manner in which it is defined. By placing the motor housings at the interface between the two resilient members, the vibrating motion of the motors will be attenuated and thereby rendered inefficient. The device taught by the prior art utilizes a storage battery to power the vibrating units. Utilization of this power source substantially compromises its ability to efficiently operate over any reasonable period of time. Lastly, the vibrating motors require the use of replaceable eccentric weights in order to vary the amplitude of vibration. This feature requires disassembly of the unit in order to change the magnitude of vibration.

The present invention substantially resolves all of the inadequacies exhibited by the prior art. The present invention converts alternating current to a twelve volt DC power source for activating the vibrating motors. The motor housings are imbedded within a unitary foam pad in order to efficiently transmit the vibratory motion caused by the activated motors throughout the entire surface area. Most importantly, by activating and deactivating the motors in a predetermined sequence, the amplitude of the vibratory motion can be changed without disassembly of any portion of the apparatus.

SUMMARY OF THE INVENTION

The present invention comprises a vibrating massage apparatus in the form of a pad. The structural elements of the pad comprise an elongated polyurethane foam member which is covered with flexible vinyl or other suitable material. The upper surface of the covering material has disposed thereon a plurality of elevated, resilient surfaces which are adapted to be in contact with predetermined segments of the user's anatomy. These locations include the nape of the user's neck, upper back, lower back, buttocks and calves. The purpose of the elevated resilient members is to focus the transmission of vibratory motion to the selected regions of the user's anatomy.

An electrically activated vibrating member is imbedded within the foam pad immediately adjacent each elevated, resilient member. Each vibrating member includes a motor having a pair of rotatable shafts which extend outwardly therefrom in axial opposition to one another. Afixed, eccentric cam is secured at the end of each shaft. The shafts are oriented perpendicular to the longitudinal axis of the pad. Each vibrating motor is securely mounted within a housing. The surface of the housing is in substantial contact with the housing and thereby transmits the mechanical vibrations of the motor through the housing to the surrounding foam. The portion of each housing adjacent the motor body is in substantial contact with a respective one of the elevated, resilient members located along the upper surface of the apparatus. The exterior surface of each housing is extended outwardly to foam flanges which lie in a plane which encompasses the shafts of the vibrating motors. The motor housings are imbedded within the foam pad, an aperture being disposed in the upper surface of the pad to provide access to the portion of the housing in contact with the motor body.

Although each of the vibrating motors can be operated independently, the novel aspect of the present invention lies in the sequential activation and deactivation of the vibrating motors in a predetermined sequence. Using a plurality of vibrating motors in the locations specified hereinabove, the sequence is as follows: (a) nape of neck; (b) upper back; (c) lower back; (d) buttocks; and (e) calves. Upon the deactivation of the vibrating motor adjacent the calves, the cycle is repeated. The sequential activation and deactivation of the vibrating motors provides overlapping changes in the amplitude of the mechanical vibrations without altering any mechanical elements.

It is therefore an object of the present invention to provide a vibrating massage device which sequentially activates and deactivates a plurality of vibrating motors in a predetermined sequence.

It is another object of the present invention to provide a self-contained vibrating massage apparatus which allows changes in the amplitude of mechanical vibrations without any change of mechanical elements.

It is yet another object of the present invention to provide a vibrating massage apparatus which provides for the uninterrupted transmission of mechanical vibrations from a plurality of sequentially operated vibrating motors.

It is still yet another object of the present invention to provide an improved vibrating massage apparatus which is inexpensive and simple to operate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
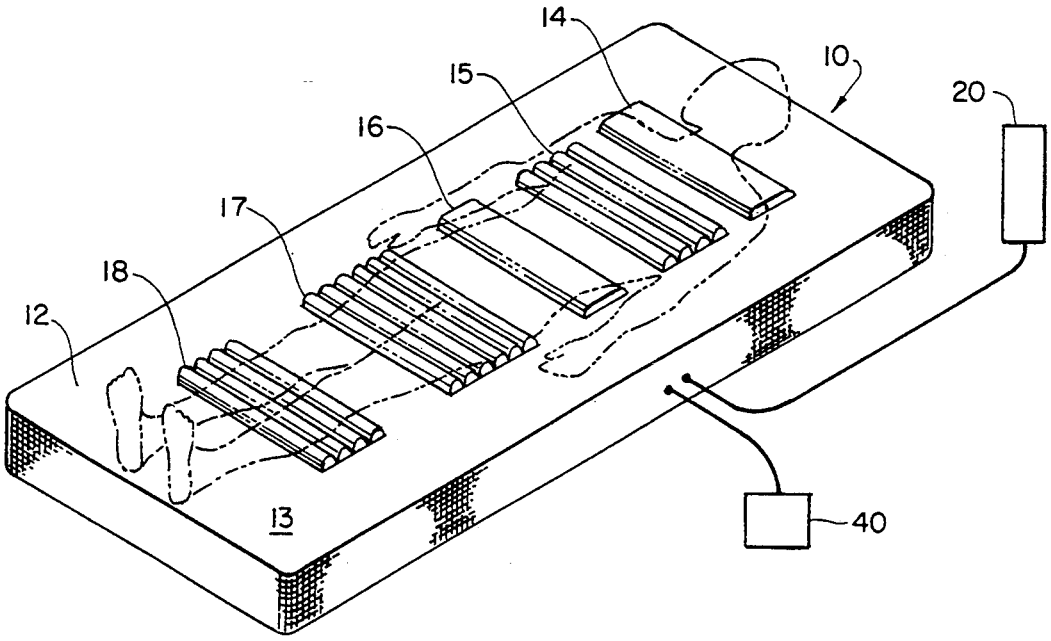
FIG. 1 is a perspective view of a vibrating massage apparatus in accordance with the present invention.

An understanding of the present invention can be best gained by reference to FIG. 1 wherein a perspective view of the invention is shown, the vibrating massage apparatus being generally designated by the reference numeral 10. Vibrating massage apparatus 10 comprises an elongated polyurethane foam pad 11 (FIG. 2) which is enclosed in a vinyl or other conventional material or synthetic covering 12. The form of the present invention 10 is determined by the configuration of foam pad 11. Although pad 11 is preferably constructed of polyurethane foam, it is understood it can be constructed of other cellular foam materials which exhibit the resilient, mechanical characteristics of polyurethane.

Upper surface 13 of vinyl cover 12 has mounted thereon a plurality of resilient members 14, 15, 16, 17 and 18 which are elevated or otherwise extend upwardly from surface 13. Each of the elevated, resilient members 14–18 are longitudinally disposed along upper surface 13 perpendicular to the longitudinal axis thereof. Each of the elevated, resilient members 14–18 are adapted to be in contact with a predetermined portion of anatomy when the user is reclining on vibrating massage apparatus 10. Elevated, resilient members 14, 15, 16, 17 and 18 are adapted to be in contact with the user's nape, upper back, lower back, buttocks and calves, respectively. The width and composition of each of the elevated, resilient members 14–18 is commensurate with the surface area with which it is to be in contact. As shown in FIG. 1, elevated, resilient members 14 and 16 constitute a single broad cushioning pad in order to be disposed within the recesses comprising the user's nape and lower back. Elevated resilient members 15, 17 and 18 comprise a plurality of adjacent individually articulated pads since they will be in contact with the broader, protruding surfaces of the user's upper back, buttocks and calves.

Figure 3:
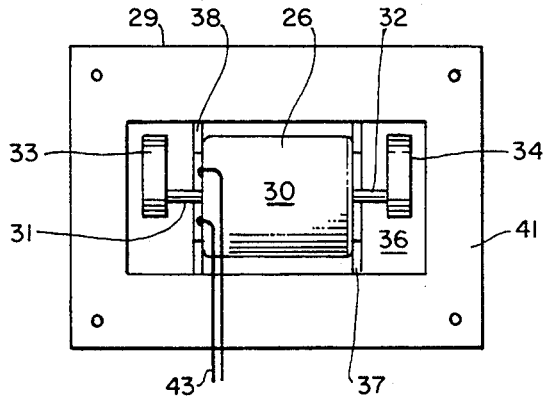
FIG. 3 is a top plan view of the vibrating member illustrated in FIG. 2 showing a vibrating motor with mounted eccentric cams.

Vibrating members 21, 22, 23, 24 and 25 are positioned along the longitudinal axis of pad 11 and are adapted to lie adjacent elevated, resilient members 14, 15, 16, 17 and 18, respectively. Vibrating members 21–25 are identical to each other and can be best understood by reference to FIGS. 3, 4 and 5.

For the purpose of describing the structure of each of the vibrating members 21–25, reference will be made only to the elements which comprise vibrating member 21. As stated, it is to be understood the structure of all vibrating members 21–25 are identical. Each vibrating member 21–25 comprises a vibrating direct current motor 26 secured within a motor housing 27 which consists of an upper housing shell 28 and lower housing shell 29 which are adapted to be engaged to one another securing motor 26 therebetween. Vibrating motor 26 comprises a cylindrical body 30 having a pair of rotatable shafts 31 and 32 axially extending therefrom in opposition to each other. A pair of eccentric cams 33 and 34 are secured at the ends of shafts 31 and 32, respectively. Since the amplitude and frequency of mechanical vibrations are controlled through the use of electronic controller 20 which will be described in detail hereinbelow, eccentric cams 33 and 34 are permanently secured to shafts 31 and 32, respectively, the weight thereof being sufficient to generate acceptable mechanical vibrations. Electric lead wires 43 extend through the interface between upper and lower housing members 28 and 29 through which vibrating motor 26 may be activated and deactivated.

In order to efficiently transmit the mechanical vibrations through motor housing 27, each of the upper and lower housing members 28 and 29 include central semi-cylindrical sections 35 and 36, respectively, which, when assembled, are annularly disposed about the cylindrical body 30 of motor 26. As can be seen best in FIG. 3, a pair of spacing walls 37 and 38 extend inwardly from the interior surfaces of semi-cylindrical surfaces 35 and 36 and are adapted to secure cylindrical body therebetween. When upper and lower housing members 28 and 29 are secured to one another, the vibratory motion of vibrating motor 26 will be mechanically transmitted to foam pad 11 through the interface between motor 26 and housing 27.

Figure 2:
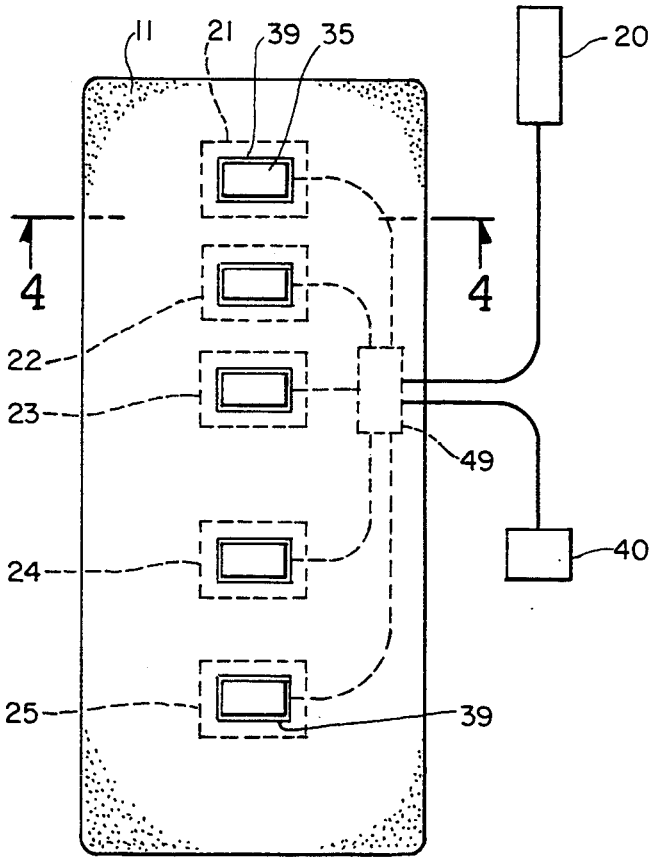
FIG. 2 is a top plan view of the internal foam pad illustrating the placement of the vibrating members.
Figure 4:
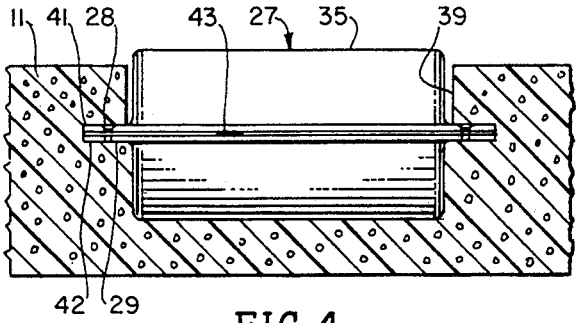
FIG. 4 is a partial, cross-sectional view of the foam pad and motor housing shown in FIG. 2 taken through line 4—4 of FIG. 2.
Figure 5:
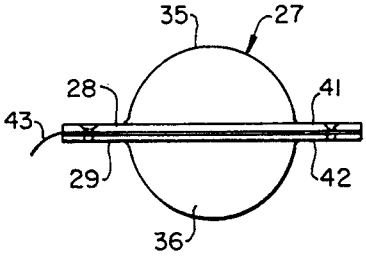
FIG. 5 is an end elevation view of the motor housing shown in FIG. 3 taken along the planar axis of the motor housing.

The ability to efficiently transmit the vibratory motion of motors 26 to elevated, resilient members 14–18 can be best seen by reference to FIG. 2 and FIG. 4. To efficiently transmit the mechanical, vibratory motion of the vibrating members, a plurality of apertures are disposed partially into the upper surface of foam pad 11. As explained, each of the vibrating members 21–25 consist of a housing 27 and an internally mounted motor 26. As can be seen in FIG. 4, vibrating member 21 is imbedded within the unitary structure of foam pad 11, the upper semi-cylindrical surface 35 of housing 27 being exposed through apertures 39. When covering 12 is disposed upon foam pad 11, the protruding upper surface 35 of each of the vibrating members 21–25 will be in direct contact with elevated, resilient members 14–18, respectively.

Upper semi-cylindrical surface 35 is extended outwardly from the base thereof into a planar flange 41. In a like manner, lower semi-cylindrical surface 36 depends outwardly into a planar flange 42. As can be best seen in FIG. 5, when upper and lower housing shells 28 and 29 are engaged, flanges 41 and 42 will lie in a plane which bisects the cylindrical profile of surfaces 35 and 36 and the internally secured motor 26. When vibrating motor 26 is secured within housing 27, shafts 31 and 32 lie within a common plane which includes flanges 41 and 42. As can be best seen in FIG. 2 and FIG. 4, each housing 27 is imbedded within foam pad 11 with flanges 41 and 42 being in parallel spaced relation to the upper surface of foam pad 11 and lower cover 12. By imbedding each of the vibrating members 21–25 within the cellular structure of foam pad 11, the mechanical, vibratory motion of motors 26 will be efficiently transmitted throughout foam pad 11.

Vibrating members 21–25 are activated and deactivated through the use of electronic controller 20. The power source for the present invention vibrating massage apparatus 10 is external power supply 40. Power supply 40 is connected to a source of 115 VAC power. Power supply 40 is a conventional power converter with a 12 volt DC output. The output of power supply 40 is coupled to electronic controller 20 and vibrating members 21–25 through a conventional terminal block 49.

Figure 6:
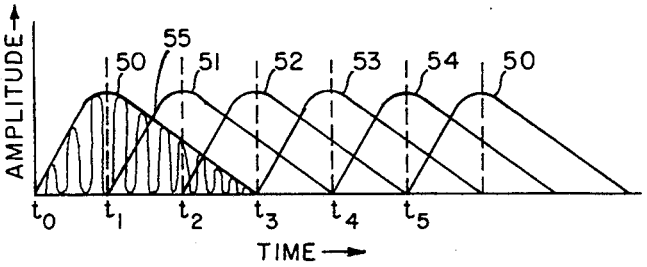
FIG. 6 is a wave diagram illustrating the overlapping vibratory motion of the sequentially operated vibrating motors.

It is an objective of the present invention to provide sequential activation and deactivation of vibrating members 21–25 and thereby produce overlapping mechanical vibrations at the interface of adjacent zones. An understanding of the overlapping vibration effect can be best seen in FIG. 6. FIG. 6 schematically depicts the amplitude of mechanical vibration at each of the five zones over a given period of time. The term "zone" is understood to refer to the physical location of an elevated resilient member 14–18 and the adjacent vibrating members 21–25, respectively.

Referring now to FIG. 6, waveform 50 schematically depicts the amplitude of mechanical vibrations produced by vibrating member 21. In a like manner, waveforms 51, 52, 53 and 54 schematically depict the amplitude of mechanical vibrations sequentially produced by vibrating members 22, 23, 24 and 25, respectively. For each zone, the rate at which the amplitude of mechanical vibration increases is substantially greater than the rate at which the mechanical vibrations decrease. Therefore, the vibratory motion in each zone is characterized by rapid increase and gradual decrease. As an example, the sequential activation and deactivation of vibrating members 21 and 22 creates an interface 55 at which the mechanical vibratory motion of the two vibrating members 21 and 22 overlap thereby creating an effective "wave" motion. The respective, sequential activation and deactivation of vibrating members 23, 24 and 25 create an identical "wave" effect.

Figure 7:
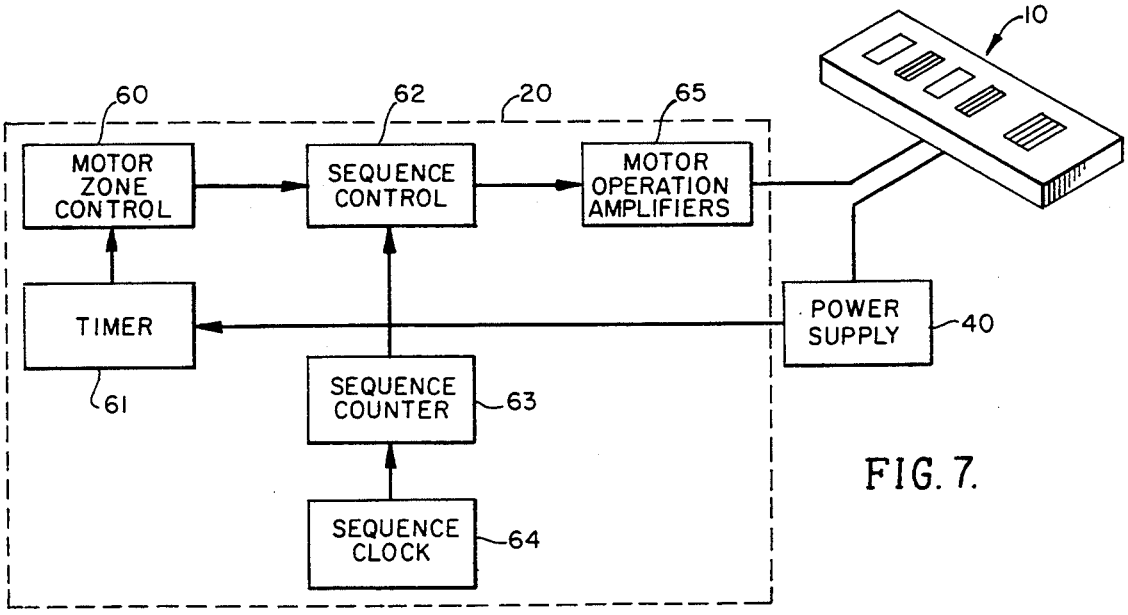
FIG. 7 is a block diagram of the electronic controller shown in FIGS. 1 and 2.

An understanding of the sequencing control for the present invention vibrating massage apparatus can be best gained by reference to FIG. 7 wherein a block diagram of electronic controller 20 is illustrated. Vibrating members 21–25 can be operated in two different modes. In a manual mode, the vibrating member located in each zone is independently operable and, if activated, will produce mechanical vibrations of a selected amplitude. The alternative mode is one which meets an objective of the present invention. In a sequencing mode, the vibrating members in sequential zones are serially activated and deactivated in accordance with the program illustrated in FIG. 6.

Motor zone control 60 provides means to independently activate vibrating members 21–25. As described hereinabove, to avoid inadvertent operation, timer 61 allows vibrating massage apparatus 10 to operate for only a predetermined interval. In the preferred embodiment, this interval is limited to eight minutes. After the expiration of eight minutes, power to electronic control 20 is disabled. Operation is resumed by deactivating and then reactivating a conventional on/off power switch. Sequence control 62, sequence counter 63 and sequence clock 64 provide means for operating in the sequence mode whereby the program of FIG. 6 is implemented. Irrespective of the mode of operation, motor operation amplifiers 65 provide independent electrical signals of sufficient power to activate each of the direct current motors 26.

Figure 8:
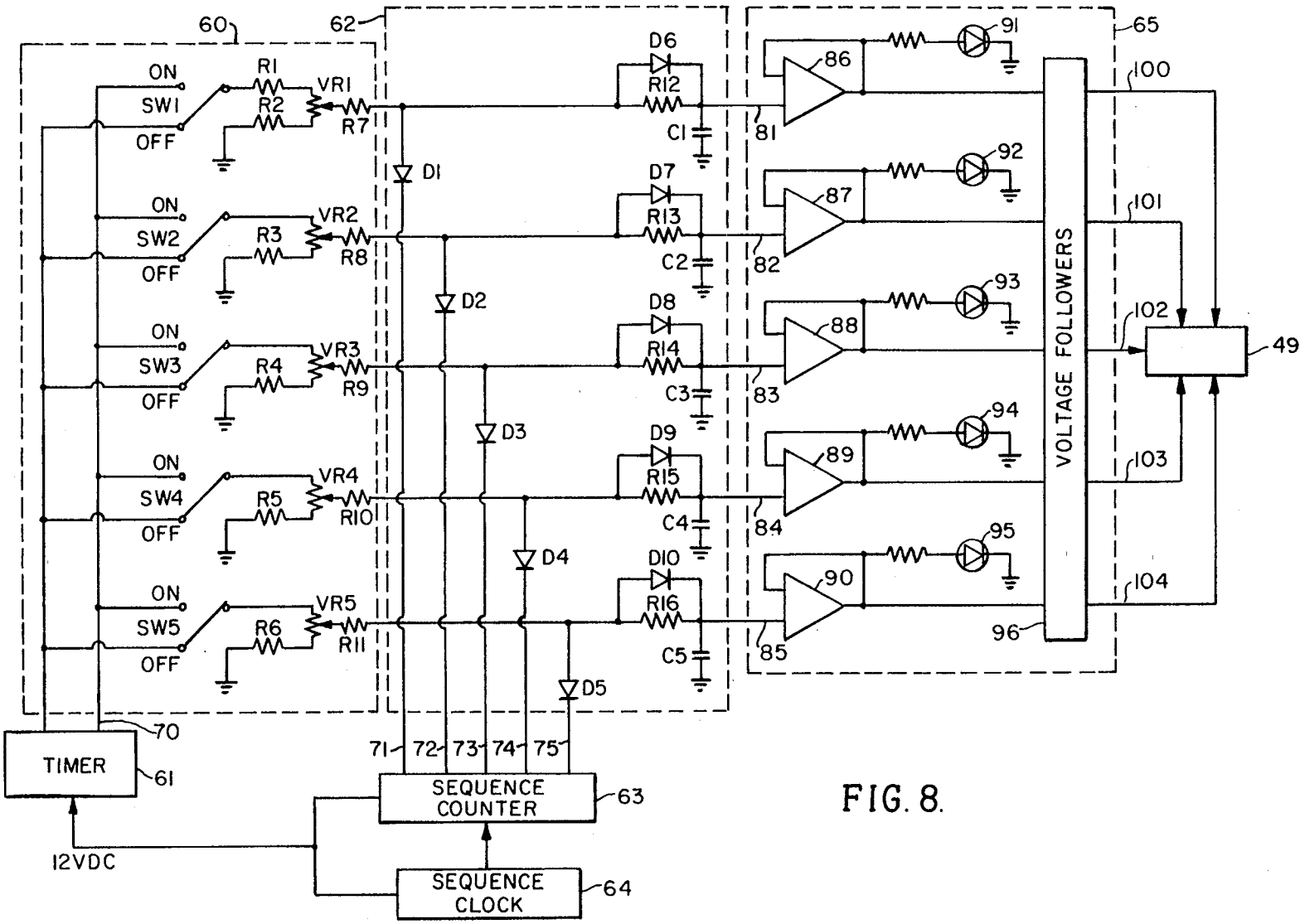
FIG. 8 is a schematic diagram of the electronic circuit used to sequentially activate and deactivate the vibrating motors.

A schematic diagram of the electrical circuit used to implement electronic controller 20 can be best seen by reference to FIG. 8. A number of the elements of this electrical circuit are conventional and are well known in the art to which the invention pertains. As stated, timer 61 provides a predetermined interval of operation for the present invention vibrating massage apparatus 10. In the preferred embodiment, this interval is eight minutes. Timer 61 is an analog timer which disables motor zone control 60 after the predetermined interval by disconnecting the power source therefrom. Sequence counter 63 and sequence clock 64 are conventional circuits known to persons having skill in the art. Sequence clock 64 is a variable oscillator which produces output signals at a predetermined rate. Sequence counter 63 is an octal counter modified to divide by five, the output thereof being connected to sequence control 62 to serially enable the vibration members 21–25 in accordance with the program illustrated in FIG. 6. Sequence counter 63 produces five independent and zone enabling signals 71, 72, 73, 74 and 75 which are used to drive sequence control 62.

To meet an objective of the present invention, the vibrating members 21–25 located within each of the five zones may be operated manually or in a sequential mode. Motor zone control 60 provides for independent control over each of the vibrating members 21–25. Switches SW1–SW5, inclusive, manually control each of the vibrating members 21–25, respectively. When timer 61 is in an enabling mode, the source voltage is output at terminal buss 70. The off state of each of the switches SW1–SW5, inclusive, are bussed to one another to allow all vibrating members 21–25 to operate in the sequential mode irrespective of the switch position. With respect to the first zone control provided by switch SW1, the combination of fixed resistors R1 and R2 and variable resistor VR1 provide a conventional circuit for attenuating the source voltage and thereby control the maximum and minimum amplitude of vibration. Resistor R3 and variable resistor VR2 permit the adjustment of vibration amplitude in the second zone. Fixed resistor R4 and variable resistor VR3 allow the adjustment of vibration amplitude in the third zone.

Fixed resistor R5 and variable resistor VR4 allow the adjustment of vibration amplitude in the fourth zone. Fixed resistor R6 and variable resistor VR5 allow the adjustment of the vibration amplitude in the fifth zone. Limiting the maximum output voltage is required in the first zone since excess vibration in the region of the user's neck may cause dizziness. In all other zones, only the minimum voltage is limited.

Electronic controller 20 provides all means for operating vibrating massage apparatus 10. A main power switch activates power supply 40. Manual switches SW1–SW5 provide for manual operation of vibrating members 21–25, respectively, in each of the five zones. Slide switches controlling variable resistors provide for a manual adjustment in the amplitude of mechanical vibrations produced by each of the vibrating members 21–25, the switches being designated hereinbelow as VR1–VR5, respectively. Electronic controller 20 includes a sequencing mode switch which will override the positioning of switches SW1–SW5, inclusive, and thereby initiate the sequencing program illustrated in FIG. 6. Limiting the maximum output voltage is required in the first zone since excess vibration in the region of the user's neck may cause dizziness. In all other zones, only the minimum voltage is limited.

A primary objective of the present invention is to provide for the sequential activation and deactivation of vibrating members 21–25 in accordance with the program illustrated in FIG. 6. This objective is met through the operation of sequence control 62, sequence counter 63 and sequence clock 64. As stated hereinabove, sequence counter 63 provides independent enabling signals 71, 72, 73, 74, 75 for each of the five zones, respectively. When in sequence mode, the variable voltage output from VR1 (first zone) is isolated from diode D1 by fixed resistor R7. The result is that the output signal from motor zone control 6g is disabled. At time $t_0$, first zone enabling signal is turned on placing diode D1 in the off state. Diode D6 allows the source voltage to rapidly charge capacitor C1. When first zone enabling signal 72 is turned off at time $t_1$, capacitor Cl discharges at a slow rate through resistor R12. As illustrated by waveform 50 (FIG. 6), the amplitude of mechanical vibrations of vibrating member 21 for the first zone exhibits a rapid increase after being enabled at time $t_0$ with a subsequent gradual decrease when disabled at time $t_1$.

In accordance with the sequencing program (FIG. 6), at time $t_1$ vibrating member 22 is activated. As exhibited by waveform 51, the amplitude of mechanical vibrations of vibrating member 22 shows a rapid increase. At time $t_1$, the amplitude of mechanical vibrations start a gradual decrease. Control is derived from second zone enabling signal 72. At time $t_1$, second zone enabling signal 72 is turned on disabling the output signal from motor zone control 60. When diode D2 is in the off state, diode D7 allows capacitor C2 to be changed to the source voltage. As with the first zone, when enabled, diode D7 causes capacitor C2 to charge at a rapid rate. When the signal is turned off at time $t_2$, the amplitude of mechanical vibrations of vibrating member 22 starts a gradual decrease. As shown in FIG. 6, interface 55 constitutes that point where the decreasing amplitude of mechanical vibrations in the fist zone (i.e., vibrating member 21) equals the increasing amplitude of mechanical vibrations in the second zone (i.e., vibrating member 22). The effect is an illusory "wave" motion which ripples down the length of vibrating massage apparatus 10 from the nape of the user's neck to the user's calves.

Activation and deactivation of vibrating members 23, 24 and 25 are identical to that of vibrating members 21 and 22. Third zone enabling signal 73 is turned on at $t_2$. As shown in waveform 52, diode D3 has been shut off thereby allowing capacitor C3 to be rapidly charged through diode DS. When enabling signal 73 is turned off at time $t_3$, the amplitude of vibrations of vibrating member 23 exhibits a gradual decrease. The fourth zone enabling signal 74 is turned on at time $t_3$. When diode D4 is off, capacitor C4 is rapidly charged through diode D9 until enabling signal 74 is shut off at time $t_4$. Lastly, fifth zone enabling signal 75 is turned on at time $t_5$. As shown from wave form 54, when diode D5 is off, capacitor C5 will be rapidly charged through diode D10 until enabling signal 75 is turned off at time $t_5$. In accordance with the sequencing program illustrated in FIG. 6, reactivation of the first zone occurs at time $t_5$ (i.e., first zone enabling signal 71 is turned on).

Output signals 81, 82, 83, 84 and 85 provide the drive signals applicable to the first, second, third, fourth and fifth zones, respectively. As shown in FIG. 8, drive signals 81, 82, 83, 84 and 85 are connected to voltage followers 86, 87, 88, 89 and 90, respectively. Voltage followers 86–90, inclusive, produce a low output impedance necessary to drive respective light emitting diodes 91, 92, 93, 94 and 95 and voltage followers 96. Light emitting diodes 91–95, inclusive, are mounted on electronic controller 20 to indicate active zones. Voltage followers 96 are conventional amplifying circuits which produce motor activation 100–104 which are coupled to individual vibrating motors 26 through terminal block 49.

It can therefore be seen the present invention provides an improved vibrating massage apparatus which substantially exceeds the capabilities and eliminates those inadequacies inherent in the devices taught by the prior art. By implementing a sequencing program, vibrating motors 26 located adjacent each of the elevated resilient members 14, 15, 16, 17 and 18 are sequentially activated and deactivated to create the illusion of a "wave" motion which ripples down the length of surface 13 of apparatus 10. By providing means to implement manual or sequencing modes and to control the amplitude of mechanical vibrations through accessible switches, the present invention may be easily operated in a manner which meets all objectives.

I claim:

1. A vibrating massage apparatus comprising:

(a) a resilient pad having a top and bottom surface and a plurality of apertures partially disposed in the top surface thereof along the longitudinal axis of said resilient pad;

(b) a plurality of vibrating members, each being secured within said pad and aligned with a respective one of said apertures, each of said vibrating members comprising:

(i) an electrically activated vibrating motor having a pair of rotatable shafts extending therefrom in axial opposition to one another and equal, fixed eccentric cams being mounted upon each of said shafts; and (ii) a motor housing securing said vibrating motor therein and including a planar flange extending therefrom, said flange being imbedded within said resilient pad in parallel spaced relation to the top and bottom surfaces of said resilient pad; and (c) operating means for sequentially activating and deactivating adjacent pairs of said plurality of vibrating motors, the mechanical vibrations of said vibrating motors being rapidly increased and slowly decreased, the mechanical vibrations of each adjacent pair of vibrating motors partially overlapping one another, said operating means being coupled to each of said vibrating motors.

2. A vibrating massage apparatus as defined in claim 1 wherein said motor housing comprises engageable upper and lower housing members, said engaged housing members defining a central cavity adapted to enclose and secure a vibrating motor therein, said planar flange extending outwardly from the cavity at the interface of said housing members.

3. A vibrating massage apparatus comprising:

(a) a resilient pad having a top and bottom surface and at least five spaced apertures partially disposed in the top surface thereof along the longitudinal axis of said resilient pad;

(b) at least five vibrating members, each being secured within said pad and being aligned with a respective one of said apertures, a portion of said vibrating member extending into and being circumscribed by said aperture and extending upwardly to the top surface of said resilient pad, each of said vibrating members comprising:

(i) an electrically activated vibrating motor having a cylindrical body and a pair of rotatable shafts extending therefrom along the axis of said body and in axial opposition to one another, and including equal, fixed eccentric cams being mounted upon each of said shafts; and (ii) a motor housing comprising engageable upper and lower housing members, said engaged housing members having a cylindrical cavity in contact with and securing a vibrating motor therein, said planar flange extending outwardly from the circumference of said cylindrical cavity in parallel spaced relation to the top and bottom surface of said resilient pad;

(c) operating means for sequentially activating and deactivating adjacent pairs said five vibrating motors, the mechanical vibrations of each adjacent pair of said vibrating motors temporally overlapping one another and being rapidly increased and slowly decreased, said operating means being coupled to each of said vibrating motors; and (d) a plurality of elevated, resilient members coupled to the top surface of said resilient pad, each being in communication with one of said vibrating members.

* * * * *